United States Patent [19]

Marsh

[11] Patent Number: 4,859,201

[45] **Date of Patent: * Aug. 22, 1989**

[54] DATA COMMUNICATIONS OUTLET

[75] Inventor: Edward K. Marsh, Kernersville, N.C.

[73] Assignee: AMP Incorporated, Harrisburg, Pa.

[ * ] Notice: The portion of the term of this patent subsequent to Jul. 12, 2005 has been disclaimed.

[21] Appl. No.: 147,110

[22] Filed: Jan. 21, 1988

Related U.S. Application Data

[63] Continuation of Ser. No. 945,401, Dec. 22, 1986, abandoned.

[51] Int. Cl.[4] ..... H01R 13/631

[52] U.S. Cl. ..... 439/290

[58] Field of Search ..... 339/14 R, 122 R, 123, 339/143 R, 47 R, 48, 49 R, 49 B, 91 R, 204, 205; 439/92-108, 535-536, 606-610, 284-295

[56] References Cited

U.S. PATENT DOCUMENTS

| | | | |
|---|---|---|---|
| 3,474,385 | 10/1969 | Cefarelli et al. | 339/47 |
| 4,210,376 | 7/1980 | Hughes et al. | 339/172 C |
| 4,221,458 | 9/1980 | Hughes et al. | 339/126 |
| 4,231,628 | 11/1980 | Hughes et al. | 339/91 R |
| 4,272,148 | 6/1981 | Knack, Jr. | 339/143 R |
| 4,292,736 | 10/1981 | Hughes et al. | 29/884 |
| 4,406,509 | 9/1983 | Jagen | 339/204 |
| 4,449,778 | 5/1984 | Lane | 339/143 R |
| 4,451,106 | 5/1984 | Wiseheart et al. | 339/123 |
| 4,477,141 | 10/1984 | Hardesty | 339/123 |
| 4,494,815 | 1/1985 | Brozostek et al. | 339/123 |
| 4,501,459 | 2/1985 | Chandler et al. | 339/48 |
| 4,508,415 | 4/1985 | Bunnell | 339/143 R |
| 4,582,376 | 4/1986 | Olsson | 339/19 |
| 4,602,833 | 7/1986 | Grabbe et al. | 339/49 R |
| 4,619,494 | 10/1986 | Noorily et al. | 335/143 R |
| 4,641,906 | 2/1987 | Olsson | 339/143 R |
| 4,653,825 | 3/1987 | Olsson | 339/48 |
| 4,671,599 | 6/1987 | Olsson | 439/188 |

FOREIGN PATENT DOCUMENTS

| | | | |
|---|---|---|---|
| 125760 | 11/1984 | European Pat. Off. | 339/143 R |

OTHER PUBLICATIONS

AMP Incorporated Instruction Sheet IS3188 (Released 2-21-87), "AMP*Shielded Champ* 180° Connector Kits and Cover Kits".

IBM Technical Disclosure Bulletin Dated Oct. 1973, entitled "Hermaphroditic Connector".

*Primary Examiner*—Joseph H. McGlynn

*Attorney, Agent, or Firm*—Eric J. Groen

[57] ABSTRACT

A one piece integrally molded outlet member includes an opening for receiving from the rear a shielded subassembly to position the shielded subassembly in a position for interconnection with a data connector. The shielded subassembly includes an insulative housing including a plurality of hermaphroditic terminals therein. The outlet has an integrally molded T-slot and an integrally molded T-bar which is interconnectable to a matable data connector. The outlet member further includes an opening for receiving from the rear an unshielded connector.

10 Claims, 11 Drawing Sheets

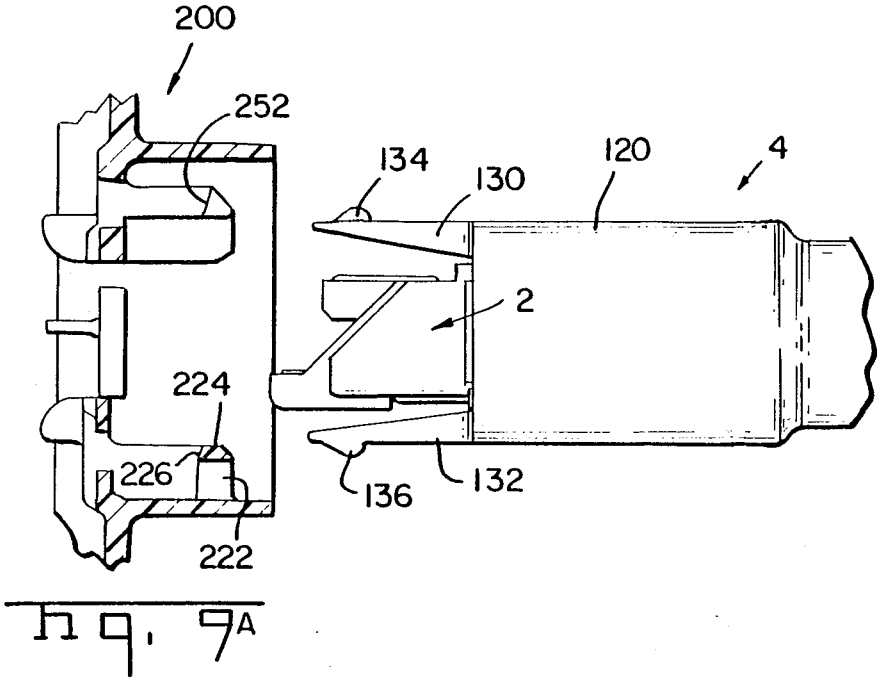
FIG. 9A
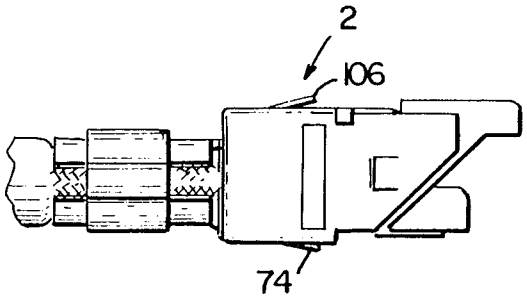

DATA COMMUNICATIONS OUTLET

This application is a continuation of application Ser. No. 945,401 filed Dec. 22, 1986, now abandoned.

BACKGROUND OF THE INVENTION

1. Field of the Invention

The instant invention relates to a communication outlet for accommodating communication network systems where more than one type of interface is utilized in the same local area network.

2. Description of the Prior Art

U.S. Pat. No. 4,501,459 discloses a local area network connector specifically intended for use in the data communications industry. These connectors can be employed in a closed loop data communications link in which various equipment such as computer terminals can be interconnected in a system. These connectors are specifically adapted for use in interconnecting numerous micro or mini computers in a computer network in an office environment. Connectors of this type have standard interface dimensions and configurations. These connectors must also be shielded to prevent spurious electrical signals and noise from affecting the signals in the network. These connectors also require a shunting capability since the conductors are part of a network and can be connected in series with other similar connectors. This shunting capability is necessary to prevent disruption of the network when an individual plug is not connected to external equipment.

The structure and components of local area network connectors of this type is represented by the structure of the connector shown in U.S. Pat. No. 4,501,459. These connectors include a plurality of spring metal terminals having insulation displacement wire barrels for establishing electrical connection with the individual conductors forming the multi conductor shielded cable. Terminals are positioned on a support housing and upper and lower shields can be positioned in surrounding relationship to the terminals and the support housing. Shield members are permanently attached to upper and lower cover members and the cover members are mated to both encapsulate the conductor and to common the upper and lower shields to the cable shielding. Similar data connectors of this type are shown in U.S. Pat. Nos. 4,449,778; 4,508,415; 4,582,376; 4,602,833; and 4,619,494; and in U.S. patent application Ser. Nos. 773,730, filed Sept. 6, 1985, now U.S. Pat. No. 4,653,825; 830,904, filed 2/18/86, now U.S. Pat. No. 4,641,906 and 823,134, filed 1/27/88, now U.S. Pat. No. 4,671,599.

Communication network systems vary in scope and design as directed by the manufacturers of the interfacing devices. Some network interface devices utilize shielded systems whereas others utilize unshielded systems. Several devices of interfacing are known in the art, for example U.S. Pat. No. 4,501,459 referred to above relates to shielded connectors for coupling two shielded cables of a shielded information network system. This connector is hermaphroditic in nature, that is, two identical connectors are utilized for the connection, and each connector can accommodate four lines of information.

Connectors for unshielded network interfaces are also known, for example U.S. Pat. No. 4,210,376; U.S. Pat. No. 4,221,458; U.S. Pat. No. 4,292,736 and U.S. Pat. No. 4,231,628 relate to network connectors or modular jacks, which are mountable to printed circuit boards and are capable of accommodating between four and eight lines of communication. These connectors include stamped and formed contacts for receiving a mating plug. Modular jacks are also available which are face plate mountable and include insulation displacement slots for terminating insulated conductors thereto.

SUMMARY OF THE INVENTION

It is an object of the instant invention to design a low cost wall outlet for data connectors.

It is an object of the instant invention to design a wall outlet which connects a data connector having T-bars and T-slots thereto.

It is an object of the instant invention to design a wall outlet which connects a data connector having a latching structure comprising raised detents.

It is an object of the instant invention to design a wall plate which has components which are interchangeable with components of a data connector having a latching structure comprising raised detents.

It is an object of the instant invention to design a data system which includes shielding substantially around the electrical contacts and exhibits adequate commoning with the shielding braid on the cable.

It is an object of the instant invention to design a wall outlet which accommodates a shielded and an unshielded interface.

The above mentioned objects were accomplished by designing a one piece plastic wall plate which is mountable within a standard outlet box for installation in a wall. The wall plate receives from the rear, a shielded subassembly which is latchably connected therein. The wall plate has integrally molded T-bars and T-slots which are interconnectable with T-slots and T-bars, respectively, on a mating data connector, to electrically interconnect the two data connectors. The wall plate also receives from the rear an unshielded modular jack which also is latchably attached to the wall plate, thereby disposing the plug opening through an opening in the wall plate.

The data connector which has a latching structure comprising raised detents has a premolded boot which is slidably receivable over, and is latchably attached to, a shielded subassembly. The shielded subassembly which is insertable from the the rear of the data connector is identical to the shielded subassembly which is used in the data connector, thereby maximizing interchangeability of components. The data connector having raised detents as a latching structure is insertable from the front of the wall plate and is latchable with the T-bars and T-slots of the wall plate.

The shielded subassembly of the instant invention includes an insulative housing having a plurality of terminals therein. The shielded cable includes a backup ferrule thereover for dressing the shielded braid thereagainst. The shielding includes a first and second shield member substantially surrounding the insulative housing and includes semicircular shield tall members extending from each of the shield members which lie adjacent to the dressed braid. A collapsible ferrule is insertable over the shield tails for crimping the shield tails, the shielding braid and the backup ferrule together.

BRIEF DESCRIPTION OF THE DRAWINGS

FIG. 3 is an isometric view of the insulative housing with the stuffer member exploded away.

FIG. 8 is a cross-sectional view taken through lines 8—8 of FIG. 4 showing the shielded subassembly also in cross-section inserted through the rear of the wallplate disposed within the data connector interface.

FIG. 9A is a view similar to that of FIG. 8 showing the shielded subassembly poised for receipt of a data connector comprising a shielded subassembly and a premolded boot.

DETAILED DESCRIPTION OF THE PREFERRED EMBODIMENT

Figure 1:
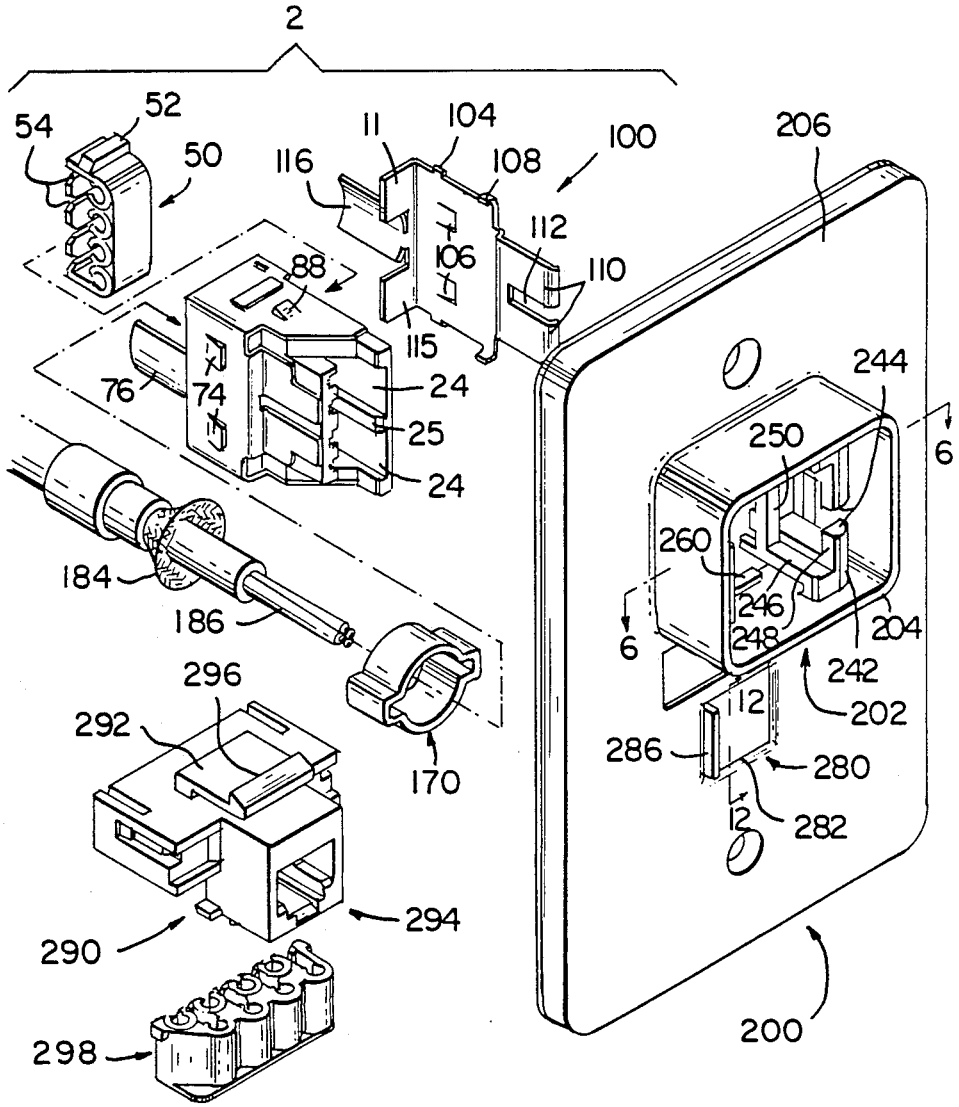
FIG. 1 is an isometric view of the components of the instant invention exploded away from the face plate.
Figure 2A:
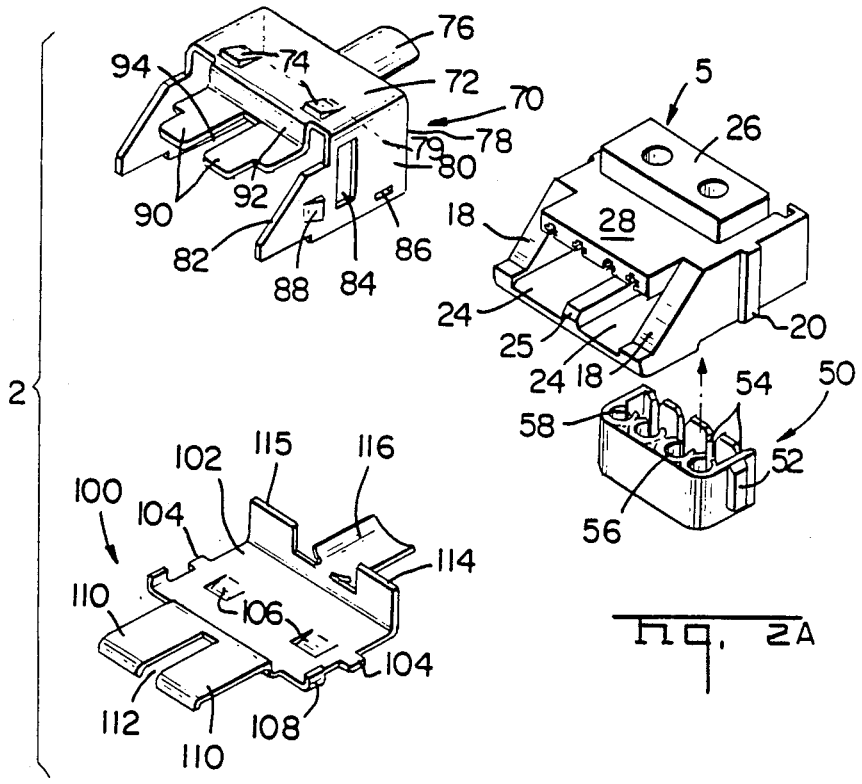
FIG. 2A is an exploded isometric view of the shielded subassembly.

Referring first to FIGS. 1 and 3, the outlet assembly of the instant invention, generally comprises a shielded subassembly 2, an unshielded connector 290 and an outlet wallplate 200, the shielded subassembly 2 and the unshielded connector 290 each being receivable into and out of the outlet wallplate 200 and being latchably attached therein. Referring now to FIG. 2A, the shielded subassembly 2 generally includes a housing member 5, a stuffer cap 50, and shield members 70 and 100. The data connector housing 5 will now be described in greater detail, with reference to FIGS. 2A and 3.

With reference first to FIG. 3, the housing 5 generally comprises a terminal support floor 20 having a plurality of channels 12 therein for receiving terminals 20. Extending upwardly from the terminal support floor are sidewalls 14 having internal grooves 22 and external ribs 20. A bridge portion 6 extends across the two sidewalls to define a front mating face for the data connector. Extending below the bridge 6 is a rib 25 which extends from the rear edge of the bridge (FIG. 3) to the forward edge of the bridge (FIG. 2A). The rib 25 defines two windows 8 which also extend from the rear edge of the bridge to the forward edge of the bridge to define two shield receiving surfaces 24 (FIG. 2A). The sidewalls 14 extend from the rear of the data connector 4 to the front mating face of the data connector to define two 45 degree surfaces at the front mating face, the surfaces being referred to generally as 18.

Terminals 30 include insulation displacement wire barrels 32, a blade portion 34, a resilient contact portion 36 and a commoning foot 38. The resilient contact portion 36 is looped back upon itself and spaced above the terminal support floor. The resilient contact portion 36 is disposed at the front mating face of the housing 5 for overlapping interconnection with like terminals, the two resilient contact portions of mating connectors contacting each other to deflect respective resilient contact portions toward the blade portion of respective terminals. Stuffer cap 50 includes alignment ribs 52 along the sides, wire receiving slots 54 and stuffer cylinders 56, the stuffer cylinders 56 having an inside diameter larger than the outside diameter of the barrels 32 of the terminals 30.

Referring now to FIG. 2A only, the shield member 70 includes a plate member 72 with continuous shield members 90 extending from the plate member 72 through a stepped portion 92, the two shield members 90 defining a slot 94 therebetween. The plate member 72 further includes two locking lances 74. The shield member 70 is shown as including a rear wall 78 extending from the plate member 72 with a semicircular shielding tail 76 extending from the rear wall 78. The shield member 70 further includes integral sidewalls 80 having windows 84 and 86 and locking lances 88. The forward edges of the sidewalls 80 are defined by two 45 degree surfaces 82.

Shield member 100 is shown as including a plate member 102 with integral shielding portions 110 extending from the front edge thereof, the two shield members 110 defining a slot 112 therebetween. The shield member 100 further includes a rear wall portion 114 having a semicircular shield tail 116 extending from the rear wall 114. Plate member 102 further comprises locking lances 106, and tabs 104 and 108 extending from the side edges thereof.

Figure 4:
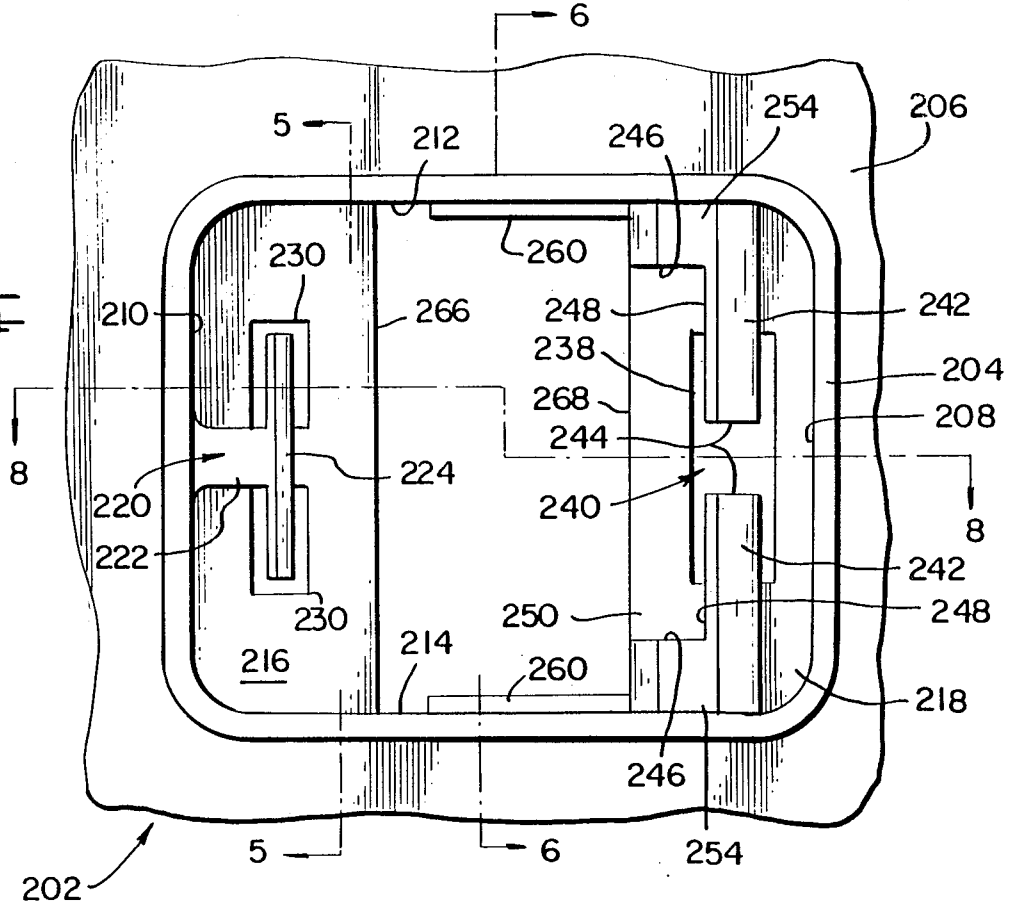
FIG. 4 is an enlarged front plan view of the data connector interface of the wallplate shown in FIG. 1.

Referring again to FIG. 1, the wall plate 200 is shown as including a data connector interface 202 and a modular plug interface 280. The wall outlet 200 is a one-piece molded housing and is used for interconnecting from the rear a shielded subassembly 2 and a modular jack 290. With reference now to FIG. 4, the data connector interface 202 is shown in greater detail.

The interface 202 generally comprises a shroud member 204 forming a peripheral wall surrounding the data connection opening to partially insulate the electrical connection between the two mating electrical components. The shroud member 204 defines an internal upper surface 212, a lower surface 214 and side surfaces 210 and 208. Also within the periphery of the shroud 204 are back wall sections 216, 250 and 218 each of which is planar with the wallplate face 206. In between the wall portion 216 and 250 is an opening defined by edges 266 of rear wall 216, edge 268 of rear wall 250 and the upper 212 and lower 214 surfaces. This opening is defined to allow the entry from the rear of the shielded subassembly 2 as will be described in more detail subsequently. Extending from the upper 212 and lower 214 surfaces are latching edges 260 which extend into the opening.

Figure 5:
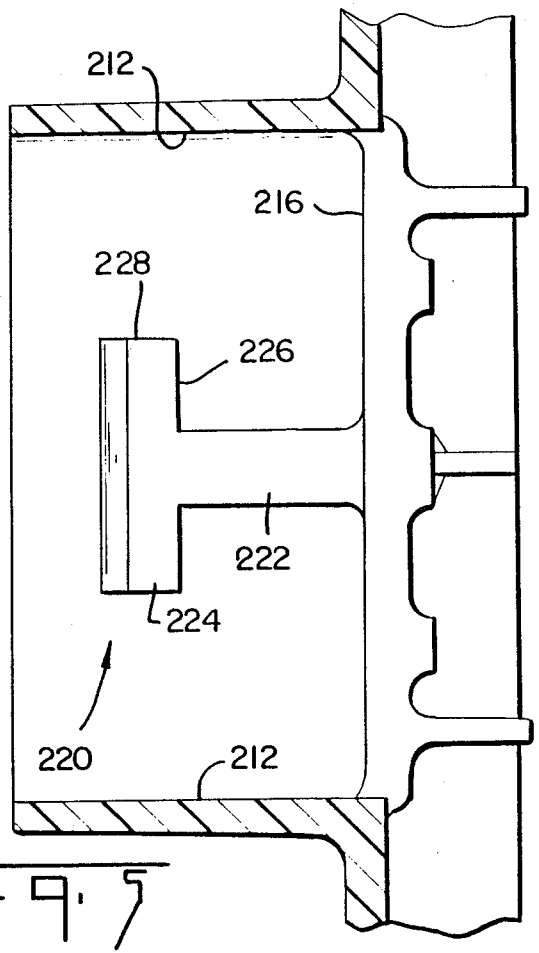
FIG. 5 is a cross-sectional view taken through lines 5—5 of FIG. 4.
Figure 7:
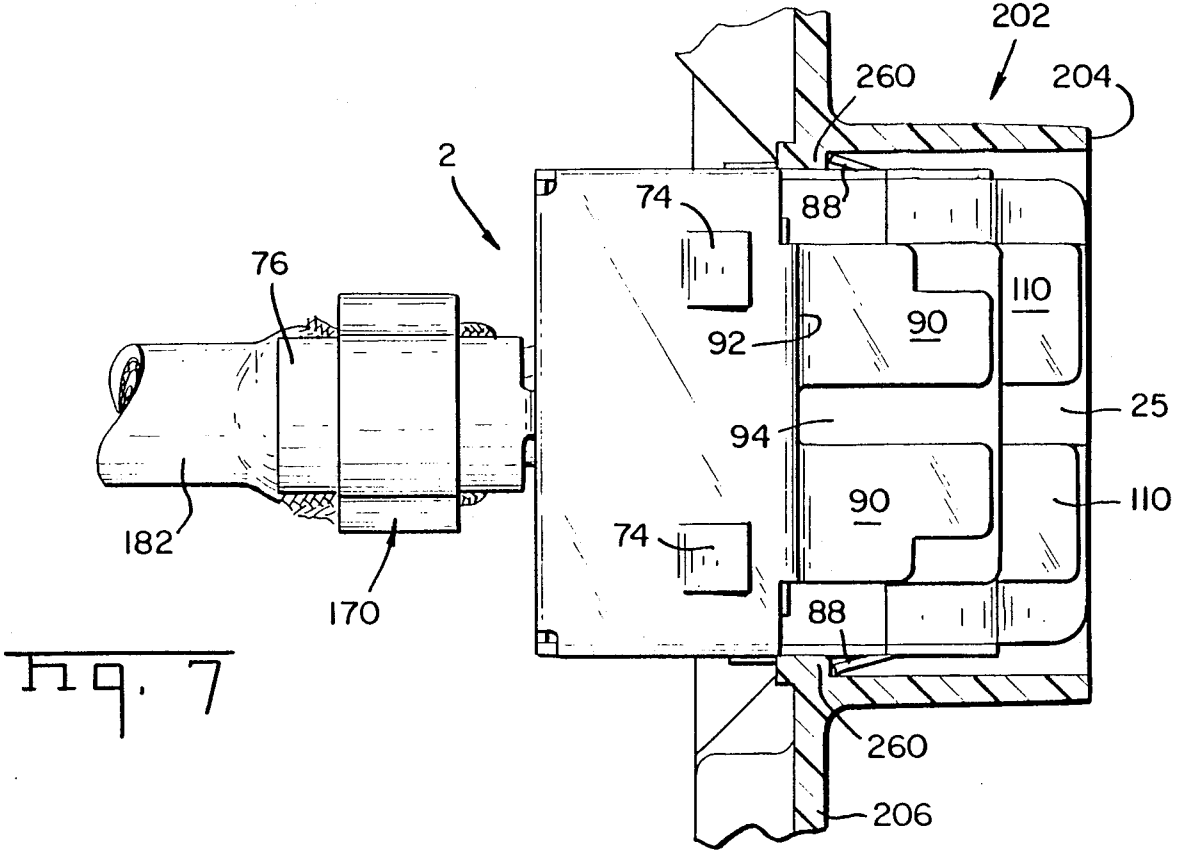
Figure 1:
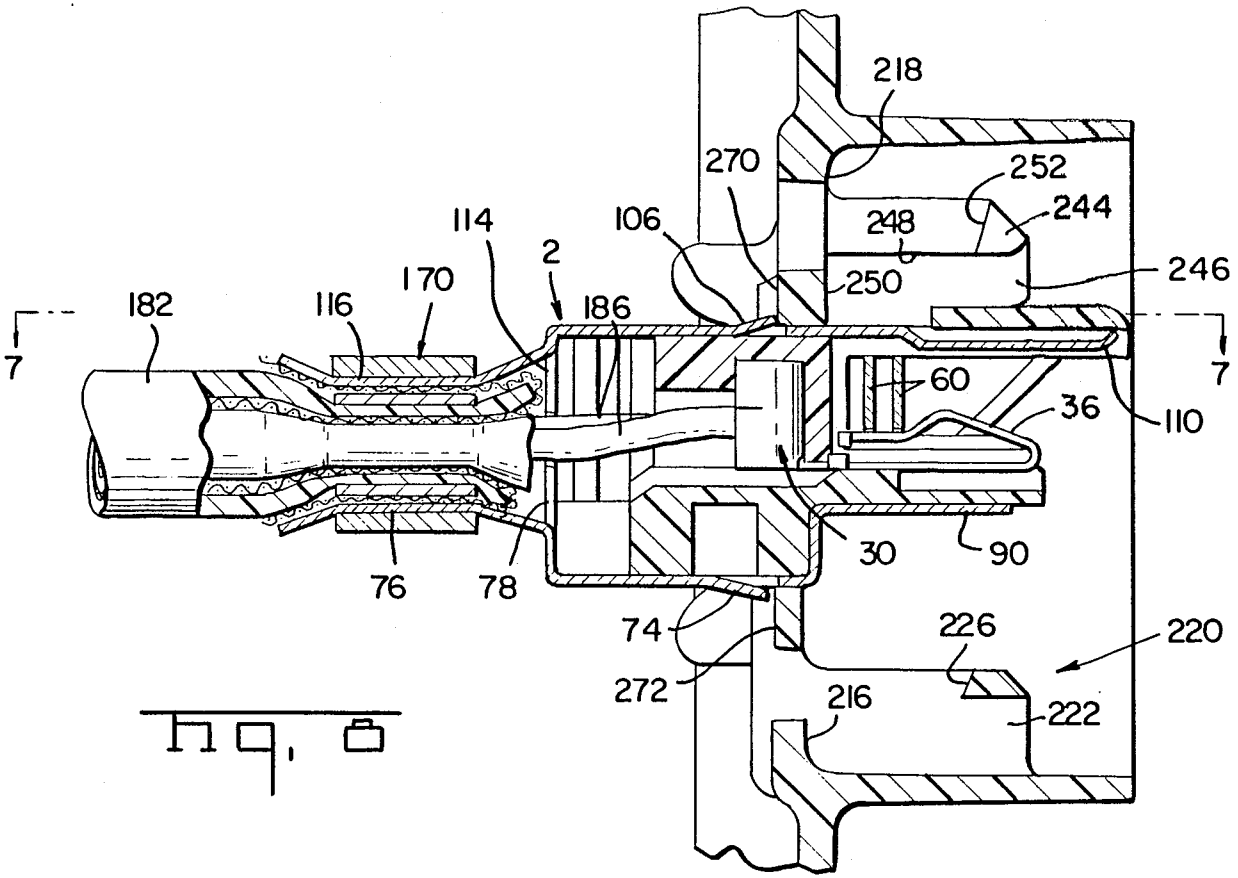

Also within the periphery of the shroud member 204 is a T-bar member 220 and a T-slot member 240. The T-bar 220 and the T-slot 240 are profiled to simulate the T-bar and T-slot of the data connectors as previously described, for example in U.S. Pat. No. 4,501,459. Referring first to the T-bar member 220, the member generally includes a bar member 224 interconnected to the internal surface 210 and to the rear wall 216 via an integral molded web 222, as shown in FIGS. 4 and 5. As best shown in FIG. 5, the rear surface of the bar 224 defines a latching surface 226 while the ends of the bar 224 form end walls 228. As best shown in FIG. 4, directly behind the latching surfaces 226 of the bar 224 and defined in the rear wall 216 is a pair of apertures 230 which extend through the wall and are generally defined by the retractable pins which define the latching surfaces 226 during the molding process.

Figure 6:
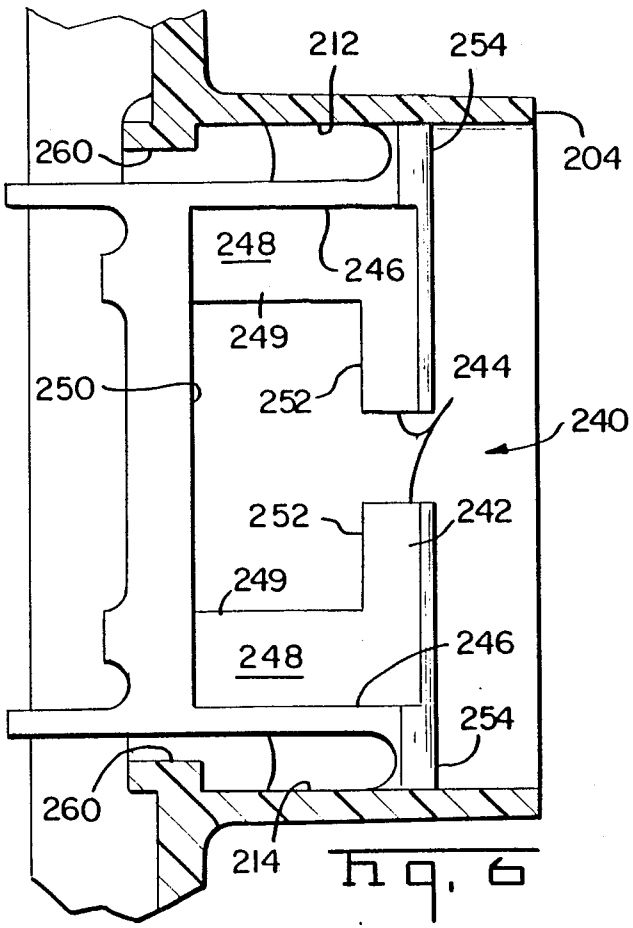
FIG. 6 is a cross-sectional view taken through lines 6—6 of FIG. 4.

Referring now to FIG. 4 and 6, the detail of the T-slot will be described in greater detail. Referring first to FIG. 6, the T-slot extends between upper surfaces 212 and lower surface 214 and is integrally molded therein via webs 254. The rear portion of the T-slot is integrally molded with the back wall portion 250 via integral portions 249. The integral web portions 254 define internal sidewalls 246 which extend from the outer edge of the web to the rear wall 250. The integral web portions 249 each have an arm 242 extending therefrom towards the center of the interface. Each of the arms is spaced from each other as defined by end surfaces 244 which also define a slot therebetween. The rear edge of the arms 242 each define a latching surface 252.

Figure 12:
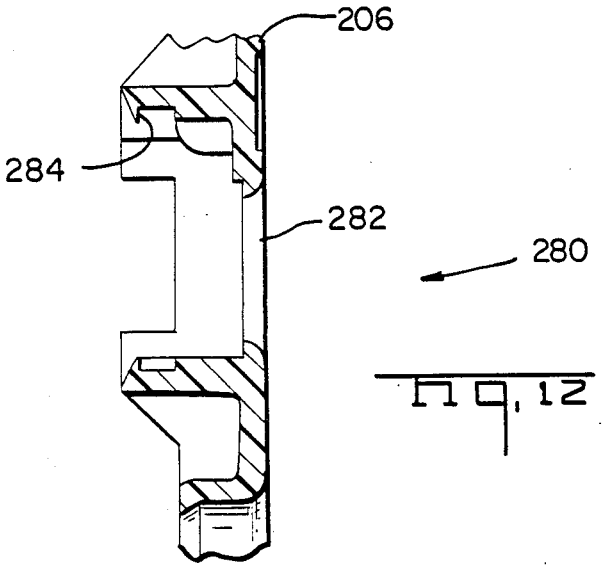
FIG. 12 is a cross-sectional view of the modular jack interface taken through lines 12—12 of FIG. 1, with a spring loaded door removed.

Referring again to FIG. 1, the assembly thereshown further includes a latchable modular jack 290 which generally includes a latching structure 292 having a latching surface 296, a modular plug interface 294 and an insulation displacement stuffer cap 298. The wallplate 200, in turn, includes a modular plug interface 280 having an opening 282 which is normally covered by a spring loaded door 286. Referring now to FIG. 12, the cross-sectional view through the modular jack interface clearly depicts the latching surfaces 284 disposed at the rear side of the wallplate behind the opening 282.

To interconnect the shielded cable 180 to the data connector of the instant invention, the housing portion 5, of FIG. 2A, is first assembled. With the shorting bars 60 removed, the terminals 30 are slidably received in respective channels 12 until latched in place. The shorting bars 60 are then inserted in respective grooves 23, the shorting bars 60 contacting the commoning foot 38 on alternate terminals to common alternate terminals when the data connector 4 is in an unmated condition. The ferrules 170 and 180 are then placed over the end of the shielded cable. The end of the shielded cable can then be prepared by stripping a portion of the outer insulation from the end of the cable to expose a portion of the shield 184, as shown in FIG. 1, the ferrule 180 is placed adjacent to the end of the stripped insulation and the exposed shielding braid 184 is dressed over the ferrule 178. The inner insulation 188 is then stripped to expose the insulated conductors 186 and each individual wire 186 is placed in the stuffer cap through a respective slot 54, with the ends of the wire 186 extending into the barrels 56 through the slot 58. The stuffer cap 50 and the individual wire 186 are then placed over the insulative housing 5 such that ribs 52 on the stuffer cap 50 are aligned with channels 22 in the insulative housing 5, which in turn aligns the stuffer cap barrels 56 with the insulation displacement wire barrels 32 on the terminals 30. The stuffer cap 50 is then pushed downwardly until each of the individual conductors 186 is terminated within respective wire barrels 32 of terminals 30.

Figure 2B:
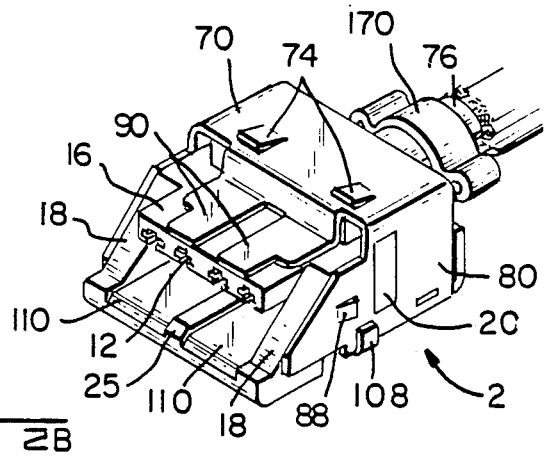
FIG. 2B is a view similar to FIG. 2A showing the shielded subassembly assembled.

The shielded subassembly 2 is completed by installing the shield members 70 and 100 to the insulative housing 5. The shield member 70 is first inserted over the housing 5 such that windows 84 in the shield 70 overlie the ribs 20 of the housing 5. This places plate member 72 adjacent to the surface 26 of the housing and shield members 90 adjacent to surface 28 of the housing. Furthermore, and as shown in FIG. 8, an installed, the rear wall 78 of the shield member lies adjacent to the rear of the connector housing 5 to substantially shield the housing member 5. This also placed semicircular shielding tail 76 in an overlying relationship with the dressed braid 184, trapping the braid between the ferrule 178 and semicircular portion 76. The shield member 100 is next installed by placing forward shield members 110 through the windows 8 of the connector housing 5 such that the forward shield members 110 lie flush against the forward surfaces 24 and between the rib 25. The shield member 100 is latched in place by locking the tabs 104 into the windows 86 of the shield member 70. As shown in FIG. 2B, the tabs 108 overlap the shield sidewalls 80 to keep the tabs 104 and the windows 86 in a latched condition.

As installed, the plate member 102 of the shield member 100 overlies the terminals 30 within the connector housing 5. The rear wall 114 of the shield member 100 encloses the rear edge of the connector housing 5 with edge 115 of the rear wall 114 substantially adjacent to edge 79 (FIG. 8) of rear wall 78 to totally enclose the connector housing. Also as installed, the semicircular shield tail 116 overlies and is substantially adjacent to the dressed braid and the backup ferrule 178. The previously installed ferrule 170 can then be slid forwardly to overlie the semicircular shield tails 76 and 116, and the ferrule 170 can be crimped to a configuration as shown in FIG. 2B. The collapsible ferrule provides for a permanent electrical connection between the shielding components, that is, the shielding braid 184 is trapped between the metal backup ferrule 178 and between the metallic shield tails 76 and 116.

Figure 7:
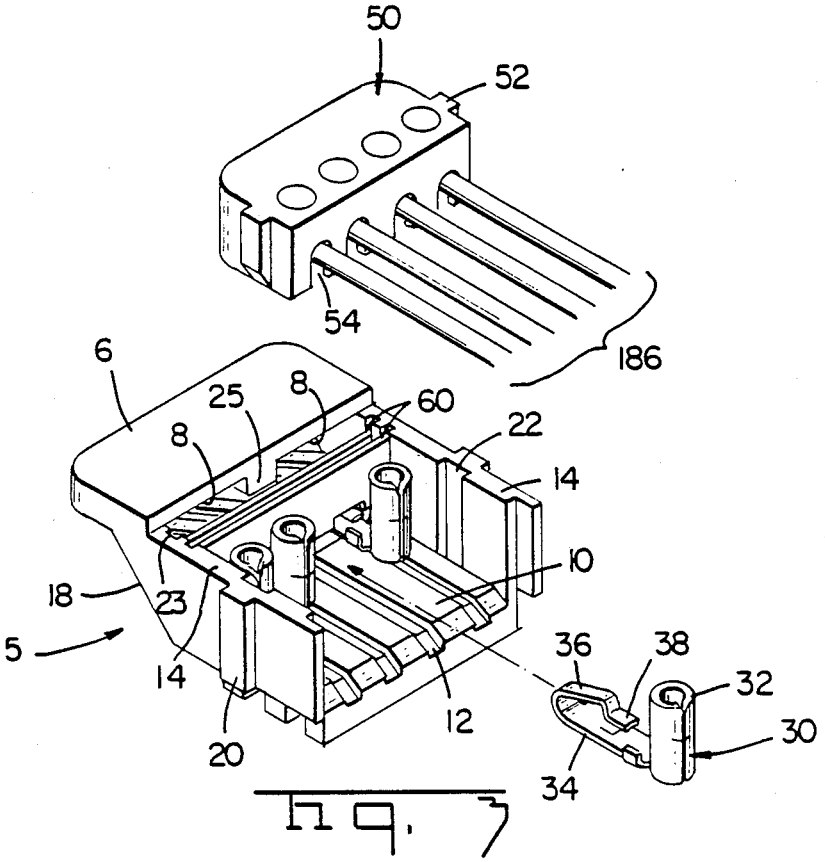
FIG. 7 is a view similar to FIG. 6 showing the shielded subassembly inserted from the rear of the wallplate disposed within the data connector interface.

With the shielded subassembly assembled as previously described, the shielded subassembly 2 is interconnectable into the opening from the rear side of the data communication interface 202. Referring first to FIG. 7, as installed the latches 88 of the shield side walls 80 lock behind the latching surfaces 260 within the opening. Also as shown in FIG. 8, as installed the latches 74 and 106 cooperatively abut rear surfaces 272 and 270 respectively maintaining the shielded subassembly in a fixed position within the wallplate. In this configuration, the shielded subassembly is disposed relative to the T-slot and T-bar for matability with a data connector of the type having a T-bar and T-slot, as will be described in greater detail subsequently.

It should be understood that the assembly as previously described is advantageous in that it can be installed within the user's facility without any assembly equipment. At most, a pocket knife is required to strip the cable and a pair of pliers is required to push the stuffer cap down to terminate the insulated conductors. Data communication lines are installed within office buildings, or the like, much like the installation of electrical power wiring, or telephone wire. Often new offices are modularly formed or new terminals are needed to compliment preexisting computer terminals. When a new shielded cable is installed, the desired method is to run the cable through the walls or through channels in the flooring to dispose the ends of the shielded cable at the required locations. The ends of the shielded cables are then prepared and the shielded subassemblies installed.

Figure 9B:
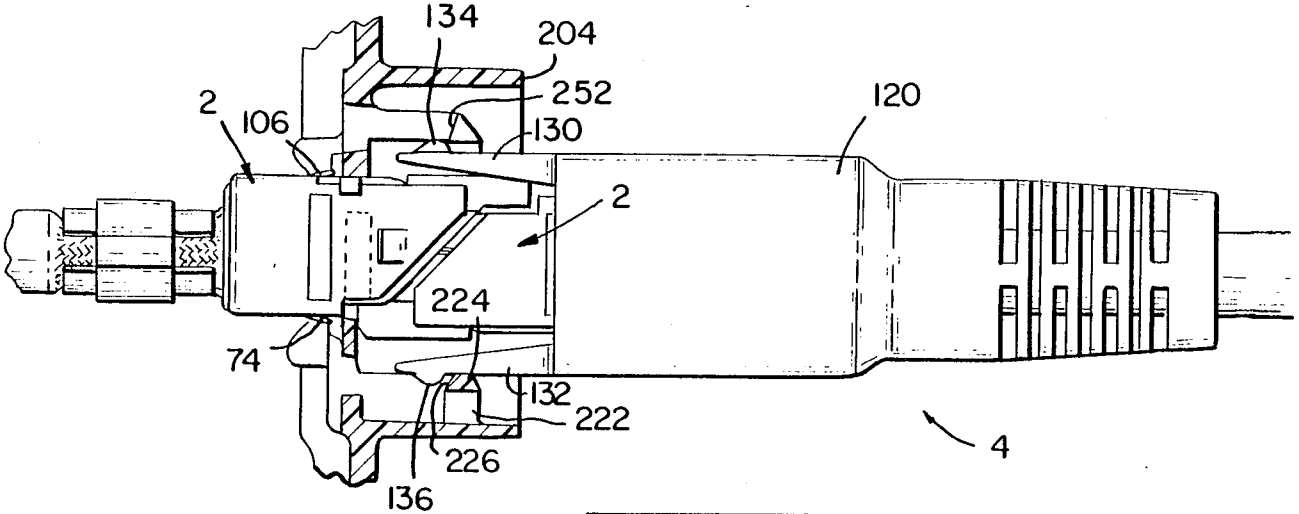
FIG. 9B is similar to that of FIG. 9A showing the two shielded subassemblies electrically connected with the premolded boot latchably attached within the data connector interface of t he wallplate.
Figure 10:
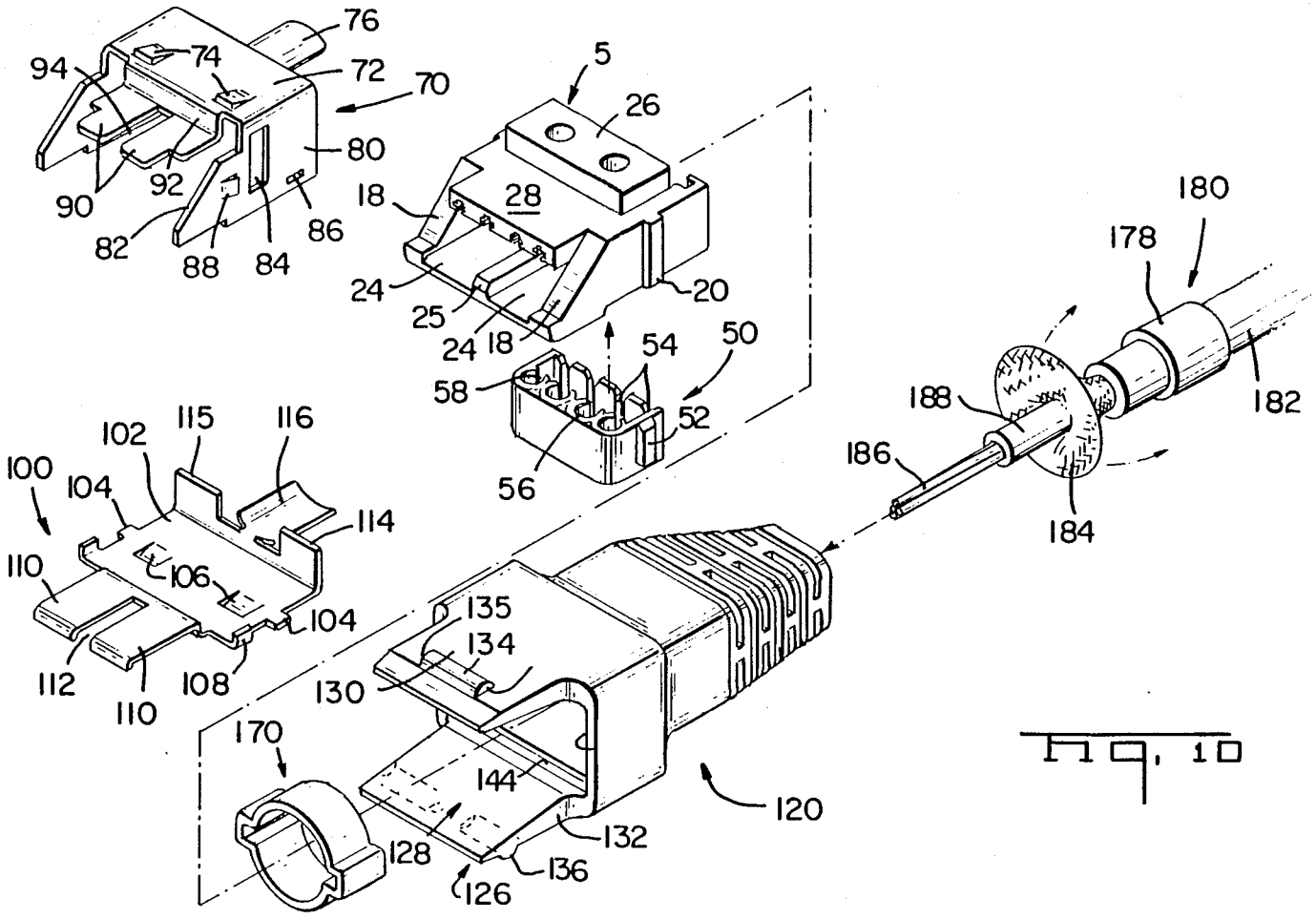
FIG. 10 is an isometric view of a matable data connector.
Figure 11:
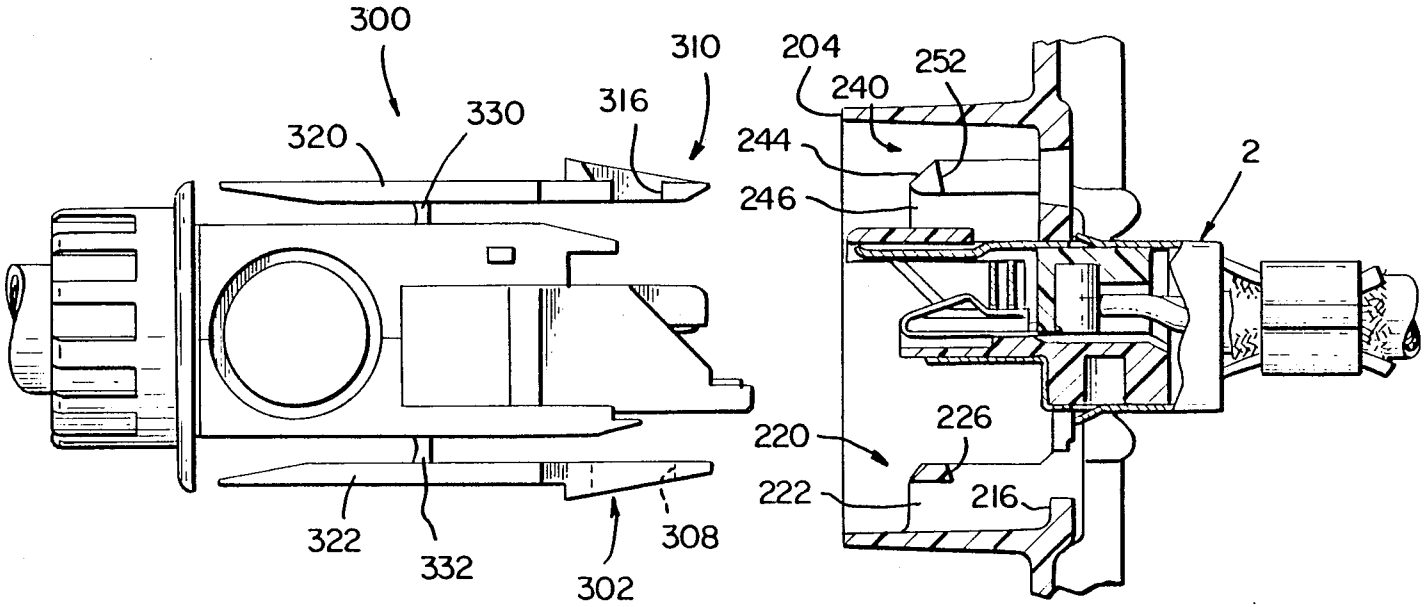
FIG. 11 shows the shielded subassembly within the data connector interface as shown in FIG. 8 poised for receipt of a data connector including a T-bar and a T-slot for latching to the wallplate.

Further advantages relate to the intermatability of the presently designed data outlet 200. As assembled, the wall outlet 200 is matable with a data connector 4, as shown in FIGS. 9A, 9B and 10, or with a hermaphroditic data connector 300, as shown in FIG. 11. The data connector 4 shown in FIG. 10 is described more fully in co-pending application Ser. No. 945,403, entitled "Shielded Data Connector", Attorney's Docket 13876, filed concurrently herewith, the disclosure of which is incorporated herein by reference. Therefore the data connector 4 will only be briefly discussed herein. The data connector 300 shown in FIG. 11 is generally of the type disclosed in U.S. Pat. Nos. 4,449,778; 4,501,459; 4,508,415; 4,582,376; and 4,602,833; and in U.S. patent application Ser. Nos. 773,730, now U.S. Pat. No. 4.653,825; 830,904, now U.S. Pat. No. 4,641,906; and 823,134, now U.S. Pat. No. 4,671,599; the disclosures of which are incorporated herein by reference.

With respect to the intermatability of the data connector 4 with the data communications outlet 200, the data connector 4 is profiled to interconnect to the front face of the outlet 200 for electrical interconnection thereto. The outlet 200 is profiled with a T-slot 240 and a T-bar 220 for matable interconnection with the latching projections 134 and 136. As shown in FIGS. 9A, 9B and 10, the shielded subassembly is insertable from the rear of the wallplate 200 to dispose the front mating face of the subassembly in relationship for intermatability. When a data connector such as 4 is mated with the outlet 200, the latching extension arms 130 and 132 are received inside of the T-slot 240 and T-bar 220, respectively. The inside surface 246 (FIG. 6) of the T-slot 240 are profiled such that the latching extension arm 130 is received therebetween. When in the latched position as shown in FIG. 9B, the raised detents 134, 136 are received behind the latching surfaces 204, 226 of the T-slot and T-bar, respectively.

As shown in FIG. 11, the outlet 200 is also interconnectable with a data connector 300. The latching mechanism of the data connector 300 includes latch plates 320 and 322. The forward end of the latch plate 320 includes a T-bar 310 having latching surfaces 316 while the forward end of the latch plate 322 includes a T-slot 302 having latching surfaces 308. As shown in FIGS. 11, the latch plates 320 and 322 are interconnected to the insulative housing portions via web portions 330 and 332, such that the plates may be squeezed at the outer end thereof to move the respective plates away from the insulative housing. In this manner, the data connector can be inserted into the outlet interface such that the T-bar 310 is placed over the T-slot 240 and the T-slot 302 is placed under the T-bar 220.

A comparison of FIGS. 2A and 10 shows that identical shielded subassemblies 2 can either be used with the communication outlet 200 or can be used with the premolded boot 120. A typical installation of the preferred embodiment of the invention would include an outlet 200 connected to the outside of a wall, within an office building, with data communication cable similar to the shielded cable 180 within the wall or under the floor, and terminated, as previously described, to a shielded subassembly 2. The shielded subassembly 2 would then be latchably received to the back of the communication outlet 200, as shown in FIG. 8. The data connector 4, having an identical shielded subassembly 2 as in the communication outlet 200, is then matably received with the front face of the outlet 200 to interconnect resilient contact portions 36 of like terminals 30. Given that identical shielded subassemblies are required for either the data connector or the communication outlet 200, the component parts for the shielded subassembly can be easily stocked without a predetermined end to their use. Furthermore, the identical shielded subassemblies allow retrofitting of a previously assembled data connector into a communication outlet, or vise versa, a previously assembled communication outlet into a data connector.

The preferred embodiment of the invention was disclosed by reference to the specific drawings herein and with specific reference to the terminology used in the state of the art to which the invention relates in order to illustrate and exemplify the preferred practice of the invention, but not to restrict its scope; the appended claims being reserved to that end.

What is claimed:

1. An electrical wall mountable outlet including a front face plate, the outlet performing as a local area network interface which receives a matable hermaphroditic data connector from the front thereof, the data connector having a latching profile including a T-bar and a T-slot, and a plurality of hermaphroditic electrical terminals therein including resilient contact portions, and for receiving from the rear, a shielded subassembly which is latchable to the outlet and includes a like plurality of terminals, the outlet comprising a one piece molded body including retention means to retain the shielded subassembly, and latching means for the hermaphroditic data connector including an integrally molded T-bar and T-slot interconnectable with respective T-slot and T-bar of the data connector, the molded body being profiled to position the electrical terminals of the shielded subassembly in an overlapping and mating relationship when the T-bar of the outlet is in a latched configuration with the T-slot of the data connector, and when the T-slot of the outlet is in a latched configuration with the T-bar of the data connector.

2. The outlet of claim 1 further comprising a shroud member integrally molded with the outlet, to form a rectangular data connector interface.

3. The outlet of claim 2 further comprising an opening through a rear wall of the outlet for receiving the shielded subassembly therethrough.

4. The outlet of claim 3 wherein the T-bar of the outlet is disposed on a first side of the opening and includes a longitudinally extending wall integrally molded within a sidewall of the shroud member and with the rear wall, and a bar portion, integrally molded with an extending transversely of, the longitudinally extending wall.

5. The outlet of claim 4 wherein the T-slot of the outlet is defined within a wall which is disposed on a second side of the opening, integrally molded with upper and lower portions of the shroud member and with the rear wall.

6. An electrical data interconnection for electrically interconnecting two shielded data cables while maintaining grounding continuity throughout, the interconnection including:

a first shielded subassembly including an insulative housing which houses therein a plurality of terminals having resilient contact portions and means interconnectable with the individual conductors of a first shielded data cable, and a shield means substantially surrounding the terminals having means commoned to the shielding braid of the first shielded data cable;

a data connector having an insulative cover, including latch means, the insulative cover enclosing a plurality of terminals which are intermatable with the terminals of the shielded subassembly and includes means interconnectable with the individual conductors of a second shielded data cable, the data connector further comprising a shield means substantially surrounding the data connector terminals, and having means commoned to the shielding braid of the second shielded data cable; and an outlet means which comprises an opening for receiving the first shielded subassembly from the rear and means for retaining the shielded subassembly, the outlet means further comprising means for attaching the latch means for the data connector thereto, the attaching means maintaining the respective terminals of the data connector and the shielded subassembly in an electrically interconnected configuration, the outlet means comprising a face plate having a peripheral shroud surrounding an opening through which the shielded subassembly is insertable from the rear, the attaching means being integrally formed within the periphery shroud and extending forwardly of the face plate.

7. The interconnection of claim 6 wherein the data connector shield means substantially surrounding the data connector terminals defines a second shielded subassembly, where the first and second shielded subassemblies are identical.

8. The interconnection of claim 6 wherein the outlet attaching means comprises a T-bar and a T-slot.

9. The interconnection of claim 8 wherein the latch means of the data connector comprises a T-bar and a T-slot which are interconnectable with the T-slot and T-bar respectively, on the outlet means.

10. The interconnection of claim 8 wherein the latch means on the data connector comprises raised detent projections on first and second latch arm members which extend from an insulative cover and flank a mating face of the data connector, the detent projections on the first latch arm member including a single raised detent projection which extends transversely of the first latch arm member and is profiled to be receivable within the T-slot of the means, the raised detent projection on the second latch arm member including two raised detent projection each extending in a spaced apart configuration transverse to the second latch arm member, the two detent projections being profiled to be received behind the T-bar of the outlet means.

* * * * *